US007896567B2

(12) United States Patent
Burrowes

(10) Patent No.: US 7,896,567 B2
(45) Date of Patent: Mar. 1, 2011

(54) DISPENSING TOOTHBRUSH

(75) Inventor: Lee Burrowes, Woking (GB)

(73) Assignee: The Procter & Gamble Company, Cincinnati, OH (US)

( * ) Notice: Subject to any disclaimer, the term of this patent is extended or adjusted under 35 U.S.C. 154(b) by 1083 days.

(21) Appl. No.: 11/635,697

(22) Filed: Dec. 7, 2006

(65) Prior Publication Data

US 2008/0118300 A1 May 22, 2008

Related U.S. Application Data

(63) Continuation of application No. PCT/IB2006/054370, filed on Nov. 21, 2006.

(51) Int. Cl.
*A46B 5/02* (2006.01)

(52) U.S. Cl. ..... 401/190; 401/270; 401/278

(58) Field of Classification Search ..... 401/190, 401/270, 272, 273, 278, 279; 222/399, 635
See application file for complete search history.

(56) References Cited

U.S. PATENT DOCUMENTS

| | | | | |
|---|---|---|---|---|
| 1,988,557 | A * | 1/1935 | Jecker | 401/271 |
| 3,482,737 | A | 12/1969 | Marder et al. | |
| 3,612,706 | A * | 10/1971 | Verga | 401/190 |
| 3,753,516 | A | 8/1973 | Crider | |
| 3,869,070 | A | 3/1975 | Schmoegner et al. | |
| 4,150,522 | A * | 4/1979 | Burger | 53/470 |
| 4,615,635 | A * | 10/1986 | Kim | 401/270 |
| 4,957,260 | A | 9/1990 | Shelley et al. | |
| 5,094,842 | A * | 3/1992 | Riley | 424/52 |
| 5,208,933 | A | 5/1993 | Lustig et al. | |
| 5,301,381 | A | 4/1994 | Klupt et al. | |
| 6,902,337 | B1 * | 6/2005 | Kuo | 401/188 R |
| 2003/0221270 | A1 | 12/2003 | Kuo | |

FOREIGN PATENT DOCUMENTS

| | | |
|---|---|---|
| FR | 2 841 159 | 12/2003 |

OTHER PUBLICATIONS

PCT International Search Report dated Jul. 16, 2007.

* cited by examiner

*Primary Examiner* — David J Walczak
(74) *Attorney, Agent, or Firm* — James C. Vago; Kathleen Y. Carter; John P. Colbert

(57) ABSTRACT

An electrically driven dispensing device, particularly a toothbrush, utilizing replaceable pressurized cartridges, of the bag-in-can type. The toothbrush has a 'top-loading' structure in which the cartridge is housed in a recess at the brush end of the toothbrush handle, the recess being accessible by removing the brush head. Other features include an elastomeric valve outlet located on the brush head which can also function as a tooth wiping or polishing blade, and a non-linear drive shaft which enables the brush head to be driven from a motor located at the base end of the handle whilst keeping the handle slim in design.

12 Claims, 2 Drawing Sheets

DISPENSING TOOTHBRUSH

CROSS REFERENCE TO RELATED APPLICATION

This application is a continuation application of prior International Application No. PCT/IB2006/054370, filed Nov. 21, 2006.

FIELD OF THE INVENTION

The present invention relates to a dispensing toothbrush which is capable of dispensing high solids content toothpaste in a convenient press button operation. The invention further relates to a replacement toothpaste cartridge useful in such a brush. The invention yet further relates to constructions of such toothbrushes which facilitate the replacement of toothpaste cartridges.

BACKGROUND OF THE INVENTION

It remains the case that tooth brushing generally involves a process of squeezing toothpaste onto a toothbrush head prior to brushing. It has long been recognised that greater convenience could be afforded by providing a toothbrush with an in-built reservoir from which the dentifrice is dispensed during brushing, either intermittently or continuously. Such an approach can also facilitate a more balanced delivery of dentifrice throughout the brushing process.

Such an idea is not new. For example, U.S. Pat. No. 730,040 discloses a toothbrush having a simple receptacle for feeding a liquid dentifrice into the bristles of the brush. U.S. Pat. No. 3,217,720 describes a toothbrush that can contain more than one liquid dentifrice container, the container(s) being separate items that are loaded into the toothbrush body. U.S. Pat. No. 5,909,977 discloses a dentifrice dispensing toothbrush utilizing a refillable cartridge for storing dentifrice material and a compressible elastic button for pumping dentifrice material to the brush head. An extension of the dispensing toothbrush concept into the realm of powered toothbrushes is disclosed in U.S. Pat. No. 5,309,590, which describes a brush having hollow bristles through which the dentifrice flows. In addition to the better cleaning that electric toothbrushes generally provide, electric toothbrushes offer further particular advantages for dispensing toothbrushes, such as the possibility of using a microprocessor to control dispensing or using the power source to pump dentifrice to the toothbrush head. WO 02/41801 describes an electrically powered, dispensing toothbrush, comprising more than one product reservoir, which can selectively dispense two or more products simultaneously or sequentially. The dispensing can be under the control of a microprocessor. US 2003/0221270 and U.S. Pat. No. 6,957,925 both describe powered brushes where the power is used to pump dentifrice to the toothbrush head as well as to drive a moving brush head. The former document describes a brush with a replaceable reservoir and the latter a brush with a permanent, refillable reservoir.

Despite the obvious appeal of dispensing or 'reservoir' toothbrushes, and the many thousands of designs for them that have been suggested through the patent literature over several decades, they have not yet become commercially successful on a large scale. U.S. Pat. No. 5,918,995 discloses a brush with an integral refillable container from which dentifrice can be pumped to the brush head by a manually operated diaphragm pump. A brush as described in the patent was commercialised by Pump&Brush Finland Oy but has not received broad scale distribution. The Fresh&GO™ toothbrush was launched in the US in 2000. It is a disposable toothbrush, aimed at travelers, and as a result is of limited appeal. In October 2004, the 'IntelliClean® System' was launched onto the US market by an alliance of Royal Philips Electronics and The Procter & Gamble Company. This electrically powered 'sonic' toothbrush comprises a replaceable flexible sachet from which dentifrice can be pumped to the brush head by a manually operated diaphragm pump. Its long term market success remains to be demonstrated.

A substantial technical problem that all such brushes have to confront is that of reliably providing for the dentifrice to be easily transported from the in-built reservoir to the toothbrush head. Typically the dentifrice has to be carried through a relatively long (compared to the neck of a toothpaste tube) but narrow conduit whose dimensions are constrained by the toothbrush neck. The problem is even more acute in the case of an electrically driven brush head because the brush neck also needs to accommodate the drive train for the brush head. Further, the need for the handle to accommodate a motor and batteries has led many designs to require a long dentifrice supply conduit from the reservoir to the brush head, which further exacerbates the problem of transporting the dentifrice to the brush head. In practice this has often meant that dentifrice for dispensing brushes has had to be formulated at a lower viscosity than is typical for many commercial pastes. This, in particular, imposes a restriction on the solids content of the dentifrice and constrains the formulator of the dentifrice. Many desirable toothpaste ingredients are best used in solid form for reasons of either stability (for materials that might be hydrolysed in solution) or efficacy (such as an abrasive). A diaphragm pump sized for a toothbrush has difficulty in sucking replacement dentifrice from a reservoir if the dentifrice is of high viscosity. An alternative approach is to push the dentifrice to the bristles by using, for example, a plunger or a screw fed piston. See U.S. Pat. No. 6,056,466 for an example of this kind. The transport mechanism is normally provided at the handle end of the brush, which is not so easy to use during brushing as a push button near the neck. Some toothbrushes have addressed this by providing a neck activation feature for a base fed piston, see e.g. U.S. Pat. No. 6,142,694, which describes the Fresh&GO™ toothbrush mentioned above, and the above-mentioned U.S. Pat. No. 6,957,925 which uses an electrically operated screw-fed piston. Whilst these approaches address the problem of ease of activation, they do so at the expense of increased mechanical complexity, raising questions over the long term reliability of the brushes.

The present inventor has now developed a dispensing toothbrush which provides for convenient operation, low mechanical complexity and ease of replacement of the dentifrice reservoir.

An important feature of the brush is a replaceable pressurised reservoir of the bag in can variety, the bag being charged before use with a dentifrice and the can containing propellant between the bag and the can.

The use of propellants for dispensing dentifrice, even in a dispensing brush, is not new. U.S. Pat. No. 3,825,354 describes a toothbrush with a hollow head into which toothpaste can be injected from a separate aerosol can using a special adapter. Each of the patent documents U.S. Pat. Nos. 2,987,743, 3,592,551, 3,606,555, 3,868,188, 3,910,706, 3,937,582, WO 86/02534, EP 437706 and GB 2,313,774 describes a manual toothbrush or similar oral applicator whose handle comprises a container, in some instances a replaceable cartridge, containing a mixture of toothpaste and propellant. The propellant pressure dispenses the paste through a conduit to the brush head. Disadvantages of incorporating the propellant into the paste include i) the paste foaming as the pressure is released; ii) as the dentifrice reservoir progressively empties the density of the paste drops and the amount of paste delivered does not remain uniform; iii) remaining dentifrice may not contain sufficient propellant for it to be properly dispensed; and iv) when the propellant is in the same reservoir, dispensing of the paset from the reservoir typically only works well when the reservoir is in a single orientation. In U.S. Pat. No. 3,937,235 the pressure on the dentifrice is provided by a separate flexible bag containing a Freon® propellant. This document envisages the entire handle being replaced when the toothpaste is exhausted. In U.S. Pat. No. 5,407,287 the pressure on the dentifrice is provided by a propellant driven piston. FR 2 484 960 describes a toothpaste container of a 'bag-in-can' type of construction from which the dentifrice can be delivered as a spray.

None of the disclosures of propellant based dentifrice dispensers mentioned above provides a structure suitable for an electric brush. The present invention provides such a brush, with many advantageous features, as described herein. In particular, the invention provides for an electrically driven toothbrush utilizing replaceable bag-in-can aerosol cartridges within a compact brush structure which, amongst other advantages, is easily used and maintained by an end consumer and can be used in any orientation.

SUMMARY OF THE INVENTION

The present invention provides an electrically driven dispensing device, particularly a toothbrush, utilizing replaceable pressurised cartridges, of the bag-in-can type, within a compact structure which is easily used and maintained by an end consumer. A highly preferred feature of dispensing toothbrush herein is a 'top-loading' structure in which the cartridge is housed in a recess at the brush end of the toothbrush handle, the recess being accessible by removing the brush head. Other preferred features include an elastomeric valve outlet located on the brush head which can also function as a tooth wiping or polishing blade, and a non-linear drive shaft which enables the brush head to be driven from a motor located at the based end of the handle whilst keeping the handle slim in design. The invention further provides bag-in-can pressurised cartridges for use in such a brush. Advantages of such cartridges include the ability to uniformly dose dentifrice of high solids content, or dentifrice otherwise having a high viscosity. The invention yet further provides replaceable heads for such a brush. It will be appreciated that many of the particular features herein may be useful beyond the preferred embodiments herein in other types of dispensing or electric brushes, or indeed in other types of dispensing device.

DETAILED DESCRIPTION OF THE INVENTION

The invention will now be described in more detail with reference to component parts of the brushes and cartridges herein, first in general terms and then with reference to specific embodiments.

Definitions

A "dispensing toothbrush" herein refers to a toothbrush comprising a reservoir for holding a dentifrice and means for moving the dentifrice from the reservoir to an applicator from where it can be applied to the oral cavity. The applicator preferably comprises a set of bristles but it can instead, or in addition, comprise other elements capable of applying dentifrice to the oral cavity such as a sponge or elastomeric blades.

"Rechargeable" refers to a toothbrush or other device comprising a battery, or set of batteries, contained within a housing of the device, the battery being designed to last for substantially the entire life of the product and capable of receiving a replenishment of its electric charge whilst remaining in the device housing.

"Replaceable batteries" is intended to refer to batteries for which provision is made for their repeated removal from a device housing in order to be replaced by equivalent charged batteries, or by the same batteries after having been recharged in a battery charger external to the device housing.

"Electrically driven" refers to a toothbrush or other device comprising a moving part, such as a toothbrush head, driven by electric power.

The term "replaceable cartridge" is used herein to refer to a unit for containing a dentifrice or other product, generally a fluid product, which can be removably inserted into a dispensing toothbrush or other dispensing device according to the invention so that an empty cartridge can be replaced with a full one after its product has been fully dispensed, or so that the cartridge, even though not fully used, can be substituted with one containing a different type of product.

"Bag-in-can" refers to a, generally rigid, pressurised, bi-compartmental container wherein the useful product in the container is contained within a flexible bag held inside the container and sealed from a propellant held in the space between the bag and an outer wall of the container. A valve attached to the container allows the product to be dispensed when the valve is opened, through the action of pressure by the propellant upon the flexible bag. The term "bag-in-can" herein encompasses the terms "bag-on-valve" and "bi-can" which are used in the art to describe containers of similar bi-compartmental construction. In each case the term also extends to the use of a container comprising two or more bags which may be connected to a common valve or to independent valves so that, e.g. incompatible dentifrice materials can be stored separately but dispensed together or sequentially.

References to "longitudinal" as applied to the brushes and other dispensing devices herein refer to a direction extending generally along an axis from an end of the handle to an end of the applicator head. References to "transverse" refer to a direction generally perpendicular to the longitudinal direction.

Toothbrushes

Many of the features described herein would be useful in a variety of dispensing devices, such as toothbrushes, paint brushes, toilet cleaners, hair brushes, razors, and the like. The preferred embodiment herein though is a dispensing toothbrush, particularly an electrically driven toothbrush, and more preferably a rechargeable, electrically driven toothbrush.

The rechargeable, electrically driven toothbrush according to the invention comprises a handle and a detachable, replaceable, applicator head, especially a brush head, comprising at least one moving section. The handle has a housing for containing an electric motor for supplying motion to the brush head through the intermediacy of a drive shaft and gears, and a rechargeable battery for supplying power to the motor. The handle further houses a bag-in-can pressurised cartridge and control means for controlling, in particular, the motor and/or the fluid dispensing. The cartridge initially contains a dentifrice or other fluid and is replaceable when the cartridge is emptied or if it is desired to use a different fluid type. The applicator head comprises a drive shaft for moving the applicator head and a conduit, such as a flexible tube, for transporting fluid from the cartridge to the brush head where it can be dispensed. The various elements will now be described in turn.

Cartridge

The purpose of the cartridge is to provide a removable container for storing dentifrice within the brush and to enable the delivery of the dentifrice to the applicator head. The cartridge product is preferably loaded into the handle of the toothbrush and then becomes attached to the applicator head when the head is attached to the handle. The cartridge may in some designs remain attached to the applicator head when the head is removed from the handle. As an alternative possibility for loading the cartridge, it can be attached to the applicator head first and then both components are fitted to the handle in one action when the head and handle are assembled.

Suitable cartridges for a dispensing brush can take the form of a flexible sachet attached to a pump as used in the Intelli-Clean® System described above. However, in this sort of system the pump can have difficulty dispensing high viscosity products. Another cartridge form can be a piston driven cylinder, as described in U.S. Pat. No. 6,142,694 where the piston is draw up the cylinder by means of a flexible cord. The flexible cord is attached to a wheel mounted on the device body or brush head. The wheel can be driven physically by the user or could be driven by the same motor that used to drive movable parts of the applicator head. The cartridge could also take the form of a bag in bottle or de-laminating bottle, wherein the bottle is flexible. When external pressure is applied to the bottle, such as through a window in the brush handle, product is forced from the bottle and towards the applicator head. When pressure is released, external air replaces the space previously taken up by the bag and its contained product.

However, a highly preferred embodiment for the cartridge is a valved, pressurized bag in can system. Cartridges of this type are known in the art, are commercially available and can be filled using well known methods. The cartridge has a sufficiently rigid wall to maintain its shape throughout its life. The valve comprises a valve stem which is external to the cartridge and upon depression of which the valve is opened and the product will flow into a conduit connected to the valve stem and leading to the applicator head.

In a preferred embodiment herein the dispensing toothbrush comprises a handle portion to which the applicator head is detachable connected, the handle portion comprising a recess for housing the bag-in-can cartridge, the recess having a longitudinal axis which is aligned with a longitudinal axis of the handle portion and an opening facing the end of the handle portion to which the applicator head attaches, wherein the recess is accessible for insertion and removal of the cartridge when the applicator head is detached from the handle. This allows the cartridge to be readily replaced by another of similar type whilst keeping the overall fluid flow path short, which helps to avoid clogging.

Preferably the valve of the cartridge is a tilt valve, thus removing the need for a vertical or longitudinal movement of the valve stem or cartridge and allowing the cartridge to be operated with a lateral movement by a push button or tab arranged on a side surface of the brush handle or head. In an alternative embodiment a system of levers can be used to effect a vertical or longitudinal movement of the valve stem in response to a lateral movement by a user of a push button or tab on the side of the brush handle or head. In order to assure a secure attachment of the cartridge to the conduit, or to provide a mechanism for allowing a user to recognise which cartridges are appropriate for the device, the valve stem can have a non-circular cross-section or the cartridge can be provided with a protuberance adjacent to the valve stem so that the conduit must have a matching cross-section or indent in order for the cartridge properly to fit the brush head.

The flexible bag within the bag-in-can cartridge contains the fluid, especially a dentifrice, to be dispensed. One advantage of the bag-in-can system is that the pressurising propellant is kept separate from the dentifrice. This avoids propellant entering a user's mouth, thereby giving more flexibility in choice of propellant, and also avoids premature foaming of the dentifrice which will typically contain a surfactant and will usually be aqueous. A further advantage of the pressurised bag in can system is that the dentifrice is pushed out of the cartridge, allowing high viscosity compositions to be dispensed, such as those comprising a high level of solids. In preferred embodiments herein a dentifrice to be dispensed comprises at least 5%, preferably at least 10%, more preferably at least 15% particulate solids. A yet further advantage is that toothpaste can be dispensed irrespective of the orientation of the brush, which is particularly helpful for dispensing further paste whilst the brush is in use.

Furthermore, a cartridge herein can comprise more than one bag, such as two, or even three, bags. This may be advantageous when it is desired to use dentifrice ingredients which are sufficiently incompatible with each other to preclude long term stable storage in the same formulation. As an example, one bag might include a dentifrice formulation comprising hydrogen peroxide, or a persalt which releases hydrogen peroxide, and a second bag within the same cartridge could contain a dentifrice formulation comprising a metal ion or pH modifier for activating the hydrogen peroxide. Preferably the cartridge comprises a single propellant chamber pressurising both bags. Alternatively the cartridge may be divided into different compartments, each comprising a separate bag and propellant chamber. This may be of advantage if the dentifrice or toothpaste formulations within the bags have substantially different rheologies and yet it is desired to dispense each of them at the same rate since different propellant pressures can then be used to modify the dispensing rates. The bags can be connected to a common valve so that the toothpaste formulations are co-dispensed when the valve is actuated. As an alternative embodiment each bag may have its own valve which can be actuated independently of the others. In this way sequential dispensing of two or more formulations can be achieved whilst retaining the convenience advantage of having a single replaceable cartridge.

The dimensions of the cartridge are chosen to suit the brush handle in which it is stored and are suitably from about 15 mm to about 25 mm, preferably about 20 mm, in diameter and from about 50 to about 90 m in overall length. Such a cartridge can readily accommodate from about 15 to about 75 ml of dentifrice.

Applicator Head

The electric toothbrush of the invention comprises an applicator head having at least one moving section. The head will generally comprise a relatively narrow, elongated, hollow neck portion which allows the working part of the head to reach the back of a user's mouth without discomfort to the user. For further convenience in use the neck portion may be angled or curved. In preferred embodiments the applicator head is detachable from the handle portion of the toothbrush. Many structures are known in the art for releasably attaching an applicator head to a handle, for example bayonet fittings or co-operating tabs and notches. The head typically comprises a head drive shaft which couples to a drive shaft in the handle when the head is attached to the handle. Mechanisms for doing this are known in the art, such as that described in WO 01/19281. The drive shaft can be a rotating or a reciprocating shaft, a reciprocating shaft is preferred. In the preferred embodiments the applicator head comprises a set of brushing elements projecting from the head. For a toothbrush the elements will normally project perpendicularly to a longitudinal axis of the head. The brushing elements can be those conventionally used in toothbrushes, particularly bristles or tufts of bristles. The bristles can be traditional polyamide bristles or they can be made of an elastomer, to be more suitable for gum massaging. The applicator head can comprise more than one moving section, such as described in WO 03/039393, or it can comprise a moving section located adjacent to a static brush section as described in EP 990 401.

The head will further comprise a fluid conduit for delivering dentifrice from the cartridge to a dispensing point on the head. This conduit will generally couple to the valve stem of the bag-in-can cartridge described herein when the head is attached to the handle. Preferably the conduit will have an internal diameter of at least 2 mm. A flexible tube, made out of e.g., silicone rubber, can be used to form a suitable conduit along all or part of the fluid flow path. In an alternate construction the conduit can at least partly be formed by the hollow interior of the neck portion, a dividing internal wall portion being used to divide the neck interior into a fluid conduit and a channel for accommodating the drive train. The use of neck walls of an applicator head for forming at least part of a fluid conduit is described in WO 2005/05187. An advantage of using the neck interior as the fluid conduit is that it allows a wider conduit to be used, for ease of fluid flow, whilst keeping the neck relatively narrow.

The conduit has a first end that couples to the valve stem of the cartridge. This end is preferably provided with a funnel shaped nozzle to assist in locating the stem within the conduit. If the valve stem and the first end of the conduit are both made of a relatively soft plastic such as polythene of polypropylene then a friction fit between the two can afford a fluid tight seal. As indicated above, the first end of the conduit may have a particular non-circular cross-section and/or an indent, in order that only a correctly shaped valve stem will fit to it.

A second end of the conduit opens to at least one hole in the applicator head forming a dispensing point for the fluid. Of course, provision can be made for more than one dispensing point. A dispensing valve is preferably fitted to the or each hole to prevent inadvertent leakage of dentifrice and to protect the dentifrice from drying out when the brush is not in use. A suitable dispensing valve is a slit valve made of an elastomer so that the valve opens automatically when the fluid in the conduit is pressurised and closes when the pressure is released. A preferred form of slit valve is a duckbill valve. Suitably the duckbill valve is made from an elastomer having a Shore A hardness of from 25 to 85, preferably from 35 to 70. When such an elastomer hardness is used the duckbill valve can be made to perform double duty as a polishing or massaging element as well as dispensing the dentifrice. In such cases the duckbill valve preferably has a width of least 5 mm. In preferred embodiments herein the applicator head comprises a set of brushing elements, the longest of which project from the head by a first length, and at least one duckbill valve which projects from the head by a second length, wherein the second length is from about 50% to about 150%, preferably from about 80% to about 120%, of the first length. The dispensing valve can be located on a stationary portion of the applicator head.

Returning to the fluid conduit, its first end is preferably capable of being laterally displaced i.e. displaced at right angles to the toothbrush head. This can readily be arranged if at least this end of the conduit comprises a flexible tube. In this manner a button can be arranged in the neck of the applicator head, the button being exposed to the outside of the head and capable of being depressed such that it bears against the first end of the conduit and displaces it laterally. When the first end of the conduit is coupled to a tilt valve on the cartridge this provides a straightforward mechanism for a user to activate the fluid dispensing function of the brush.

The whole applicator head can be manufactured cheaply so that replacement heads can be sold at reasonable cost.

The Toothbrush Handle

The handle portion of the rechargeable, electrically driven toothbrush herein forms the housing for the cartridge, an electric motor, one or more batteries and control means for controlling, in particular, the motor and/or the fluid dispensing. The handle portion has a first end to which the head attaches and an opposed second end on which the brush can stand when not in use. The motor will typically be coupled to a drive train within the handle comprising a drive shaft, the handle drive shaft being coupled to the head drive shaft, as described above, when the head is attached to the handle. The drive train may further comprising gears and/or motion converters for e.g., transforming a rotary motion of the motor into a reciprocating action for the drive shaft. Whilst replaceable batteries can be used to power the motor a rechargeable battery is preferably used so that the handle can be supplied as a sealed unit. In this case the handle will generally also contain a charging coil. Ancillary features such as a charging indicator can also be incorporated. The control means will typically comprise a microprocessor and one or more switches.

A preferred construction for the handle consists of a supporting central chassis to which external housing parts of the handle are affixed. The chassis has first and second ends corresponding to those of the handle and comprises recesses into which the cartridge, motor and battery can be inserted and carries external bushes and clips for affixing and guiding the drive shaft. Since, in this embodiment, the drive shaft runs along on side of the handle in order to by-pass the cartridge, a highly preferred feature is at least joint in the drive shaft which enables the shaft to be non-linear whilst continuing to transmit a reciprocating motion. This arrangement allows the handle to be kept slim.

It is highly advantageous for the handle to comprise a recess at its first end for accommodating the cartridge. This recess has a longitudinal axis which is aligned with a longitudinal axis of the handle portion and an opening facing the first end of the handle, wherein the recess is accessible for insertion and removal of the cartridge when the applicator head is detached. This recess is suitably formed in the central, supporting chassis of the handle. The particular advantage of this arrangement is that the valve stem of the cartridge is at the first end of the handle and can couple directly to the fluid conduit in the applicator head so that the handle portion need not contain any fluid conduits itself. The chassis can further comprise a second recess for housing the motor. This second recess is preferably formed in the side of the chassis so that the motor spindle is transversely oriented within the brush. A third recess in the second end of the chassis houses the battery. The major components of battery, motor and cartridge are thus longitudinally disposed within the handle and arranged in the order of battery, motor and cartridge, passing from second end to first end of the handle.

The invention will now be described in more detail by reference to preferred particular embodiments.

DESCRIPTION OF THE PREFERRED EMBODIMENT

Figure 1:
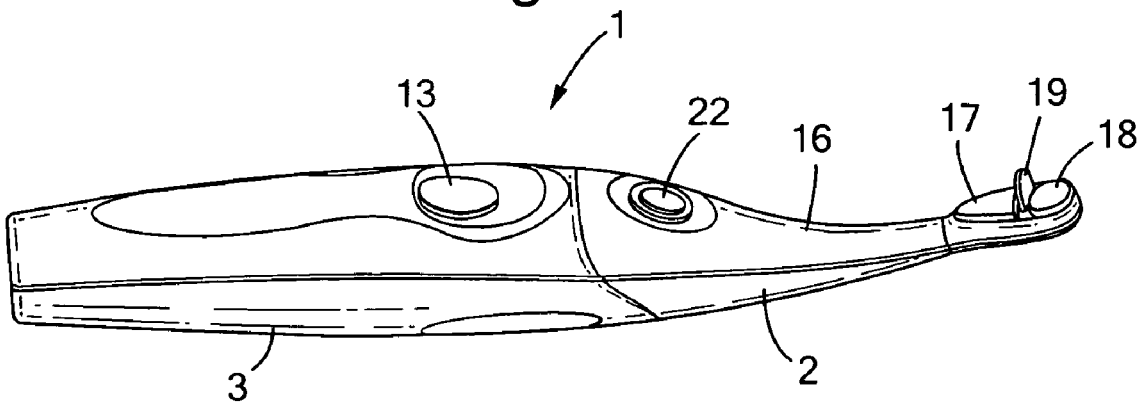
FIG. 1 is a perspective view of a rechargeable, electrically driven toothbrush according to the invention. The head has two moving brush plates but the bristle tufts have been omitted to show the dispensing duckbill valve more clearly.
Figure 2:
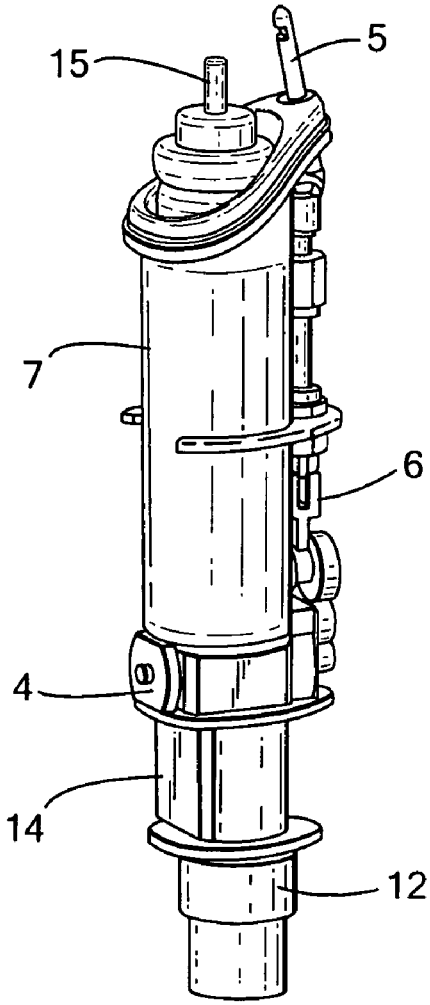
FIG. 2 is a perspective view of the handle of the toothbrush of FIG. 1 with the external housing parts removed to show the internal parts and construction.
Figure 3:
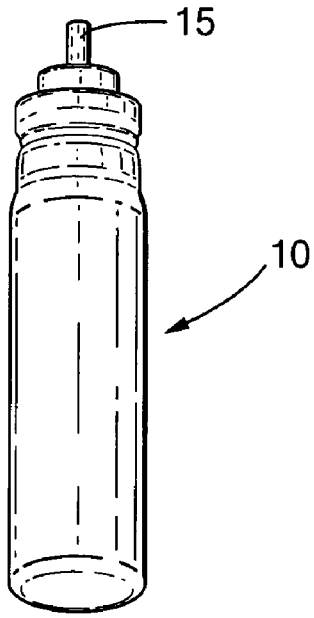
FIG. 3 is a perspective view of a cartridge according to the invention.
Figure 4:
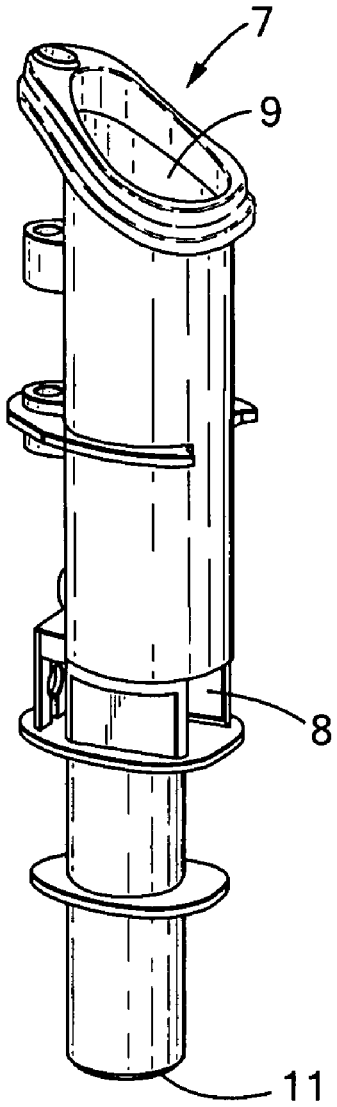
FIG. 4 is a perspective view of the chassis of the toothbrush of FIG. 1.

Referring to FIGS. 1 to 4, a rechargeable, electrically driven, dispensing toothbrush 1 according to the invention comprises an applicator head 2 and a handle 3. Handle 3 contains a motor 4 and handle drive shaft 5. The motor is coupled to the drive shaft by a crank 6 which transforms a rotary action of the motor into a reciprocating action of the drive shaft. The handle drive shaft is supported on an external face of a central chassis 7, shown separately in FIG. 4. A first recess 9 in a first end of the chassis accommodates a bag-in-can cartridge 10, shown separately in FIG. 3. Recess 9 is open towards the first end of the chassis so that the cartridge can easily be inserted or removed but is closed on all other surfaces so that when the handle is fully assembled the cartridge is isolated from the other working parts of the handle. The chassis further includes a second, transverse recess 8 for housing motor 4. Chassis 7 includes a third recess in its second end 11 for insertion of a rechargeable battery (not shown). A charging coil 12, for recharging of the battery, fits around the second end of the chassis. The handle further includes an on-off switch 13 for operation of the motor. A printed circuit board 14 provides circuitry for operation of the electronic parts of the brush.

Cartridge 10, which contains a dentifrice paste, is fitted with a tilt valve 15 extending outwards along a longitudinal axis of the cartridge. A transverse movement of the tilt valve opens it, allowing the pressurised gas inside the cartridge to expel the dentifrice through the valve.

Figure 5:
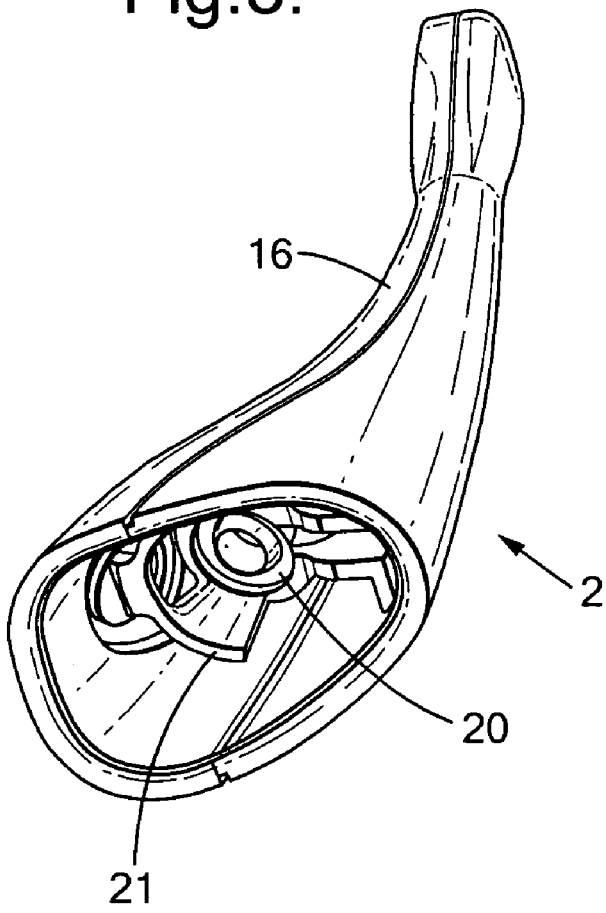
FIG. 5 is a perspective view of the head of the toothbrush of FIG. 1 with the external housing parts removed so that its component parts and construction can be seen.

Referring now to FIGS. 1 and 5, the toothbrush 1 includes a detachable applicator head 2 which clips onto the handle 3. The handle includes an elongated curved neck 16 and a head drive shaft (not shown) which couples to the handle drive shaft 5 when the head is attached to the handle. The head drive shaft couples to two moving bristle plates (not shown in FIG. 5). Bristle plate 17 is coupled to the head drive shaft for a longitudinally reciprocating motion. Bristle plate 18 is coupled to the head drive shaft for an oscillating motion. Each bristle plate comprises a conventional number of bristle tufts (not shown). The tufts extend from the head to a length of 10 mm. Located on a stationary portion of the head between the two moving bristle plates is a duckbill valve 19 which extends from the head to a length of 10 mm. Head 2 includes a flexible tube (not shown) which acts as a conduit for delivering dentifrice from the cartridge in the handle to duckbill valve 19. The flexible tube has a first end terminating in a nozzle 20 for receiving the valve 15 of cartridge 10. A second end of the tube terminates at a hole in the head to which duckbill valve 19 is attached. When the dentifrice is released from the cartridge as tilt valve 15 is opened, the dentifrice forces open duckbill valve 19 and is dispensed. Duckbill valve 19 is made from an elastomer of 50 Shore A hardness and has a width of 10 mm along the transverse axis of the head. It has a slight curvature along the transverse axis to curve around the oscillating bristle plate 18. Duckbill valve 19 is long enough in relation to the bristle tufts of the bristle plates 17 and 18 that it can effectively act as a polishing element as well as a dispensing point for the dentifrice.

As described above, nozzle 20 receives the tilt valve stem 15 of the bag-in-can-cartridge when head 2 is attached to handle 3. There is a friction fit between the valve stem and the nozzle so that they form a fluid tight seal to prevent leakage of the dentifrice. A pusher 21 is attached to nozzle 20 and is elastically depressible by button 22 on an outer face of head 2. When the brush is assembled and button 22 is depressed, nozzle 20 is deflected sideways moving the tilt valve 15 with it, thereby opening the valve and allowing dentifrice to be dispensed. When the button is released tilt valve 15 returns to its upright position and is closed, releasing pressure on the dentifrice in the conduit and allowing duckbill valve 19 to seal.

REFERENCE KEY FOR THE PARTS SHOWN IN THE DRAWINGS

The following list provides a key to the part numbers used in the figures and their foregoing description.

1 Dispensing toothbrush
2 Applicator head
3 Handle
4 Motor.
5 Handle drive shaft
6 Crank
7 Chassis
8 Second recess
9 First recess
10 Bag-in-can cartridge
11 Second end of chassis
12 Charging coil
13 On-off switch
14 Printed circuit board
15 Tilt valve
16 Neck
17 Reciprocating bristle plate
18 Oscillating bristle plate
19 Duckbill valve
20 Nozzle
21 Pusher
22 Depressible button The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A dispensing toothbrush comprising:

a) an applicator head comprising at least one fluid dispensing point;

b) a bag-in-can cartridge for containing a fluid dentifrice, the cartridge including a tilt valve;

c) a fluid conduit for delivering the dentifrice to the brush head, the fluid conduit having a first end and a second end, the first end being in fluid communication with the tilt valve of the cartridge and the second end being in fluid communication with the at least one fluid dispensing point; wherein the first end of the fluid conduit can be laterally displaced, thereby activating the tilt valve of the cartridge; and d) a handle portion having a first end to which the applicator head is detachably connected, a first recess for housing the bag-in-can cartridge being formed in the first end of the handle, the first recess having a longitudinal axis which is aligned with a longitudinal axis of the handle portion and an opening facing the first end of the handle, wherein the first recess is accessible for insertion and removal of the cartridge when the applicator head is detached.

2. The dispensing toothbrush of claim 1 further comprising an electric motor for supplying motion to a movable part of the applicator head.

3. The dispensing toothbrush of claim 2 which comprises a rechargeable battery for supplying power to the motor.

4. The dispensing toothbrush according to claim 1 wherein the applicator head comprises at least one duckbill valve through which the dentifrice is dispensed.

5. The dispensing toothbrush according to claim 4 wherein the duckbill valve has a width of least 5 mm.

6. The dispensing toothbrush according to claim 5 wherein the duckbill valve is made from an elastomer having a Shore A hardness of from 25 to 85.

7. The dispensing toothbrush according to claim 4 wherein the applicator head comprises a set of brushing elements, the longest of which project from the head by a first length, and the duckbill valve projects from the head by a second length, wherein the second length is from 50% to 150% of the first length.

8. The dispensing toothbrush according to claim 1 wherein the bag-in-can cartridge contains a dentifrice comprising at least 15% particulate solids.

9. The dispensing toothbrush according to claim 1 comprising a handle portion, the handle portion comprising a supporting chassis to which external housing parts of the handle are affixed.

10. The dispensing toothbrush according to claim 9 wherein the chassis comprises the first recess for housing the bag-in-can cartridge.

11. The dispensing toothbrush according to claim 10 wherein the chassis comprises a second recess for housing a motor.

12. The dispensing toothbrush according to claim 11 wherein the chassis comprises a third recess for housing a battery.

* * * * *